US005265576A

United States Patent [19]

McMahon et al.

[11] Patent Number: 5,265,576

[45] Date of Patent: Nov. 30, 1993

[54] CALIBRATION SYSTEM FOR ELECTRICALLY CONTROLLED FUEL INJECTION PUMP

[75] Inventors: Donald C. McMahon, Longmeadow, Mass.; Robert R. Winkler, Vernon; Kenneth H. Klopfer, East Hartland, both of Conn.

[73] Assignee: Stanadyne Automotive Corp., Windsor, Conn.

[21] Appl. No.: 2,193

[22] Filed: Jan. 8, 1993

[51] Int. Cl.[5] ..... F02M 37/04

[52] U.S. Cl. ..... 123/458; 123/506

[58] Field of Search ..... 123/450, 458, 506, 456, 123/490, 486

[56] References Cited

U.S. PATENT DOCUMENTS

| | | | |
|---|---|---|---|
| 4,870,939 | 10/1989 | Ishikawa et al. | 123/506 |
| 4,884,549 | 12/1989 | Kelly | 123/506 |
| 5,086,743 | 2/1992 | Hickey | 123/456 |
| 5,099,814 | 3/1992 | Ament | 123/458 |
| 5,103,792 | 4/1992 | Winkler et al. | 123/506 |
| 5,131,371 | 7/1992 | Wahl et al. | 123/456 |
| 5,178,115 | 1/1993 | Daly | 123/470 |
| 5,200,900 | 4/1993 | Adrain et al. | 123/486 |
| 5,205,262 | 4/1993 | Anton et al. | 123/506 |

*Primary Examiner*—Willis R. Wolfe
*Assistant Examiner*—Thomas N. Moulis
*Attorney, Agent, or Firm*—Chilton, Alix & Van Kirk

[57] ABSTRACT

A fuel injection system having a fuel injection pump with an electrical control valve for controlling the fuel injection timing and quantity, an electrical control unit (ECU) for storing certain data, including certain master calibration data, for regulating the operation of the control valve, a pump mounted, electrical module having a male connector for connecting the pump mounted module to the ECU, and a printed circuit board mounted on the male connector pins, the printed circuit board having a calibration resistor for establishing an electrical calibration value at one of the pins for adjusting the master calibration table for adjusting the fuel injection quantity.

19 Claims, 7 Drawing Sheets

CALIBRATION SYSTEM FOR ELECTRICALLY CONTROLLED FUEL INJECTION PUMP

The present invention relates generally to fuel injection pumps of the type having a high pressure pumping chamber with one or more pumping plunger bores, a pumping plunger mounted in each bore for reciprocation, cam means providing periodic intake and pumping strokes of the plungers for periodically supplying intake charges of fuel to the pumping chamber and delivering high pressure charges of fuel from the pumping chamber for fuel injection, and electrical valve means electrically operable for regulating the supply of fuel to the pumping chamber during the intake strokes and/or the high pressure delivery of fuel during the pumping strokes (such fuel injection pumps being hereinafter referred to as "Electrically Controlled Fuel Injection Pumps"). The present invention relates more particularly to a new and improved calibration system for calibrating the electrical operation of such pumps.

A primary aim of the present invention is to provide in a processor based control system for an Electrically Controlled Fuel Injection Pump, a new and improved calibration system for individually calibrating each fuel injection pump in accordance with the actual performance characteristics of the pump. The new and improved calibration system is useful with Electrically Controlled Fuel Injection Pumps having, for example, a pump-spill, spill-pump-spill or fill-spill mode of regulation.

Another aim of the present invention is to provide a new and improved calibration system of the type described for establishing the quantity of fuel injected. In accordance with this aim of the present invention, the processor based control system employs a master calibration table and, in addition, employs a separate calibration adjustment system for modifying the master calibration table in accordance with the actual performance characteristics of the fuel injection pump.

Another aim of the present invention is to provide a new and improved calibration system of the type described having a master calibration table which can be readily adjusted for each pump at the factory and in the field. In accordance with this aim of the present invention, the master calibration table is readily adjusted and readjusted to reflect variations in pump performance due to pump wear and dimensional variations within permitted tolerances.

A further aim of the present invention is to provide a new and improved calibration system of the type described having a component mounted on the fuel injection pump for establishing a calibration adjustment for the pump.

Other objects will be in part obvious and in part pointed out more in detail hereinafter.

A better understanding of the invention will be obtained from the following detailed description and accompanying drawings of a preferred embodiment of the invention.

DESCRIPTION OF PREFERRED EMBODIMENT

Figure 1:
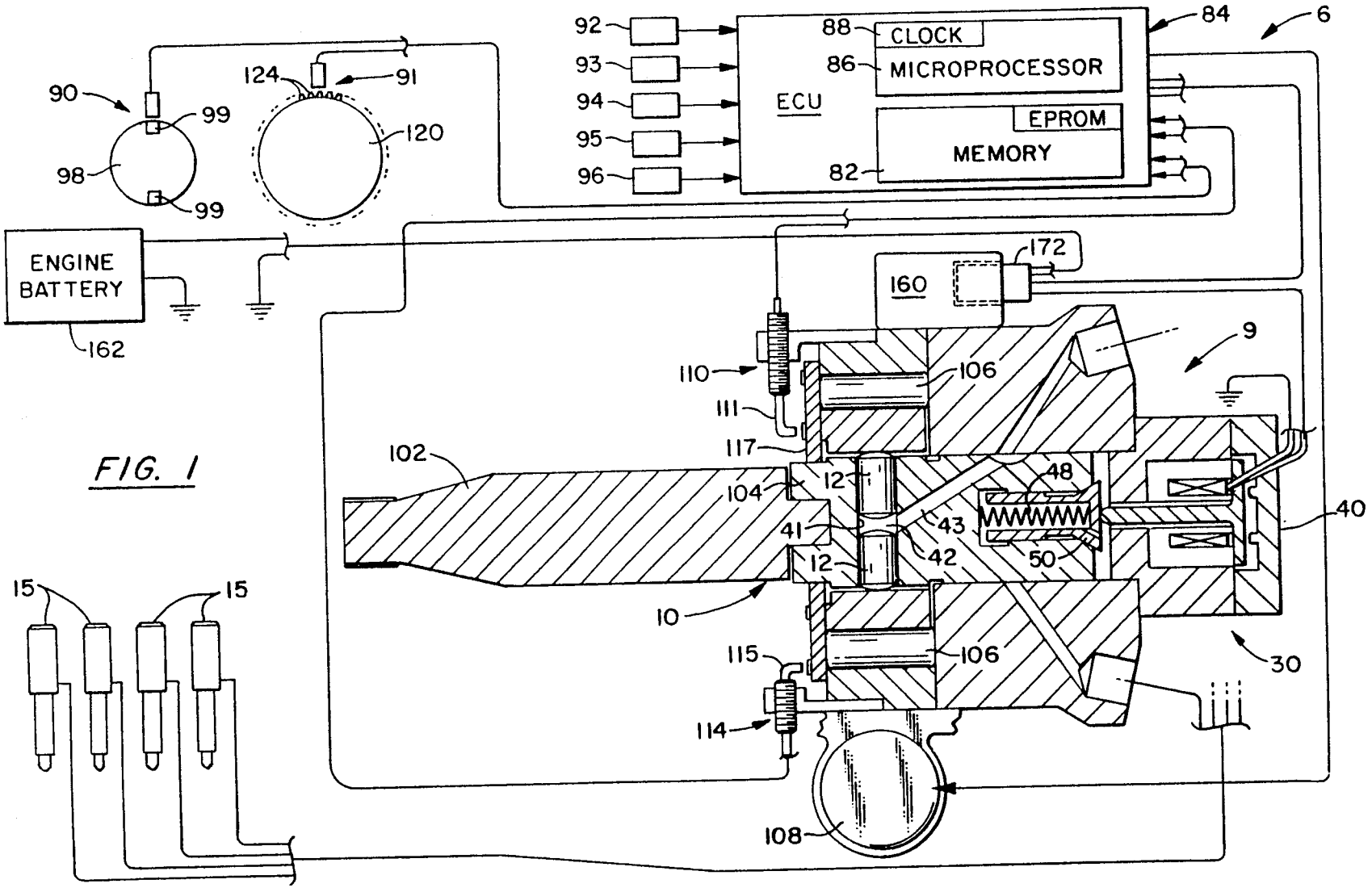
FIG. 1 illustrates a fuel injection system having a processor based control system employing a calibration system incorporating the present invention and showing a partial longitudinal section view, partly broken away and partly in section, of a fuel injection pump of the fuel injection system.

In the drawings, the same numerals are used to identify the same or like functioning parts or components. The pump calibration system of the present invention may be employed with different kinds of Electrically Controlled Fuel Injection Pumps and in different kinds of diesel engine fuel injection systems. Included are fuel injection systems, sometimes referred to as pump-spill systems, wherein the pumping chamber of the pump is completely filled during the intake stroke and the electrical valve means is opened before the completion of the pumping stroke to terminate the fuel injection event. Also, included are fuel injection systems, sometimes referred to as spill-pump-spill systems, wherein the pumping chamber is completely filled during the intake stroke and the electrical valve means is closed and then reopened during the pumping stroke. The calibration system also has notable utility with fuel injection systems, sometimes referred to as fill-spill systems, of the type described in U.S. Pat. No. 4,884,549, dated Dec. 5, 1989 and entitled "Method And Apparatus For Regulating Fuel Injection Timing And Quantity" and in processor based control systems of the type described in U.S. Pat. No. 5,103,792, dated Apr. 14, 1992 and entitled "Processor Based Fuel Injection Control System". The calibration system is hereafter described with reference to a fill-spill system like that described in U.S. Pat. No. 4,884,549 and with reference to a processor based control system like that described in U.S. Pat. No. 5,103,792. Accordingly, U.S. Pat. Nos. 4,884,549 and 5,103,792 are incorporated herein by reference.

Referring to FIG. 1, a processor based control system 6 is shown employed in a fuel injection system 8 having an Electrically Controlled Fuel Injection Pump 9. The pump 9 has a high pressure pump 10 for periodically delivering charges of fuel at high pressure to each fuel injector 15 of an associated four cylinder diesel engine (not shown). Except as otherwise described herein, the high pressure pump 10 may be generally like that disclosed in U.S. Pat. No. 4,476,837, dated Oct. 16, 1984 and entitled "Method And System For Fuel Injection Timing". Accordingly, U.S. Pat. No. 4,476,837 is incorporated herein by reference.

The high pressure pump 10 has a rotor 104 driven by a pump drive shaft 102. The rotor 104 has a pumping chamber 42 provided by a diametral bore 41. A pair of opposed pumping plungers 12 are mounted in the bore 41. A cam ring 14 encircling the rotor 104 is engageable by plunger actuating rollers 106 to reciprocate the plungers 12 to provide periodic intake and pumping strokes of the plungers 12 to supply fuel to the pumping chamber 42 and deliver charges of fuel from the pumping chamber 42 at high pressure for fuel injection. The cam ring 14 is either fixed to provide fixed plunger stroke timing or is angularly adjustable to adjust the plunger stroke timing, for example by an advance piston (not shown) controlled by a stepper motor 108 as described in U.S. Pat. No. 4,476,837.

The cam ring 14 has an internal cam with four equiangularly spaced, identical cam lobes (not shown), one for each engine cylinder. Each cam lobe has an intake ramp and pumping ramp. The slope of the pumping ramp is preferably made constant along its full length (i.e., to produce a constant plunger velocity at each pump speed) as represented by the straight pumping slope 25 shown in FIG. 2. The intake ramp is contoured to provide an intake slope 27 which is significantly less steep than the pumping slope 25.

A bidirectional flow, electrical control valve 30 is open during an initial phase of each intake stroke to supply fuel to the pumping chamber 42. The control valve 30 is closed before the end of the intake stroke by energizing a valve solenoid 40. The valve 30 remains closed during the remainder of the intake stroke and during a succeeding initial phase of the pumping stroke during which a charge of fuel is delivered at high pressure for fuel injection. The valve solenoid 40 is deenergized before the end of the pumping stroke to open the control valve 30 and spill the remaining fuel and thereby terminate the fuel injection event. A coil compression spring 48 opens the valve 30 when the valve solenoid 40 is deenergized.

An electrical control unit (ECU) 84 determines and controls the solenoid energization and deenergization during each fuel injection cycle and, where the cam ring 14 is adjustable, determines and controls the angular position of the cam ring 14. Each such determination is based on certain fixed data and certain current engine and pump operating data. The fixed data is stored primarily in the form of tables and algorithms in an EPROM forming part of an ECU memory 82. The fixed data stored in the EPROM includes pump specific data including cam profile data and installation specific calibration data. The fixed data enables the ECU 84 to determine from certain current operating data, (a) the desired timing for energizing the valve solenoid 40 to achieve the desired fuel injection timing, (b) the desired stroke reference (Stroke Ref.) timing, where adjustable, and (c) the desired valve opening (VO) timing to inject the desired quantity of fuel.

The current operating data includes the actual Stroke Ref. timing and the engine reference angle (ERA) offset between the engine top-dead-center reference (TDC Ref.) point and the Stroke Ref. point. Also included are the actual timing of valve energization (VE) and the valve response angle (VRA) between valve energization (VE) and valve closure (VC) (i.e., when the valve member 50 reaches its fully closed position).

Figure 2:
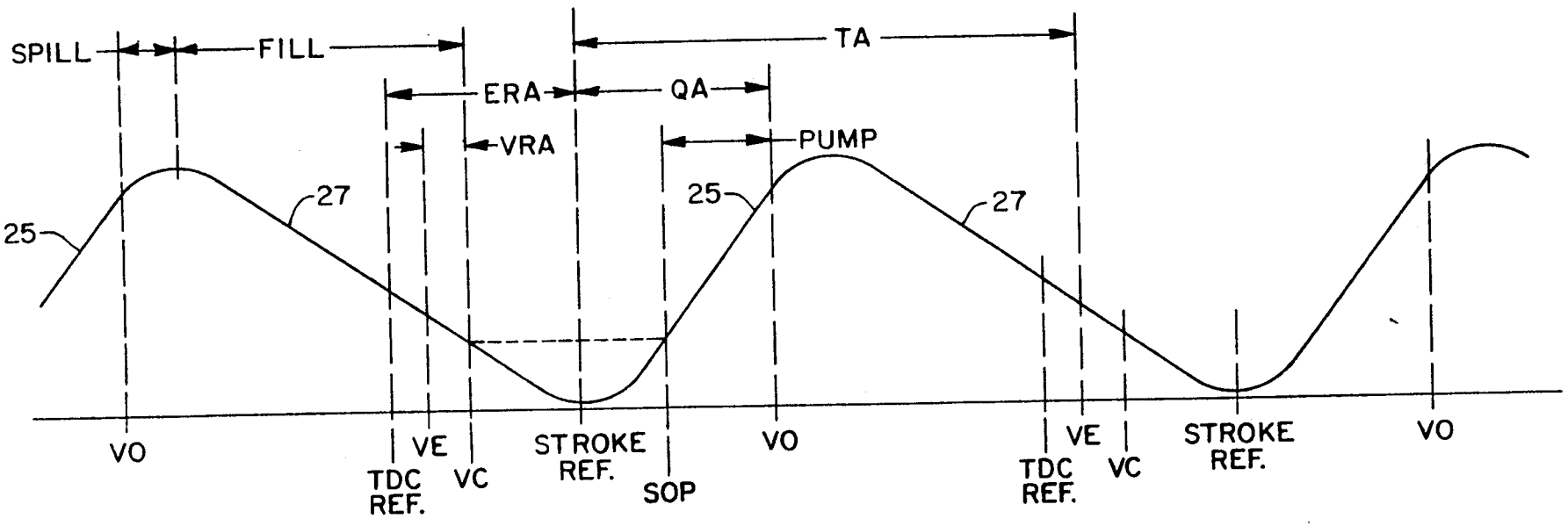
FIG. 2 is a graph showing the stroke profile of a pair of reciprocating pumping plungers of the fuel injection pump and identifying certain phases and reference points during representative cycles of reciprocation of the pumping plungers.
Figure 3:
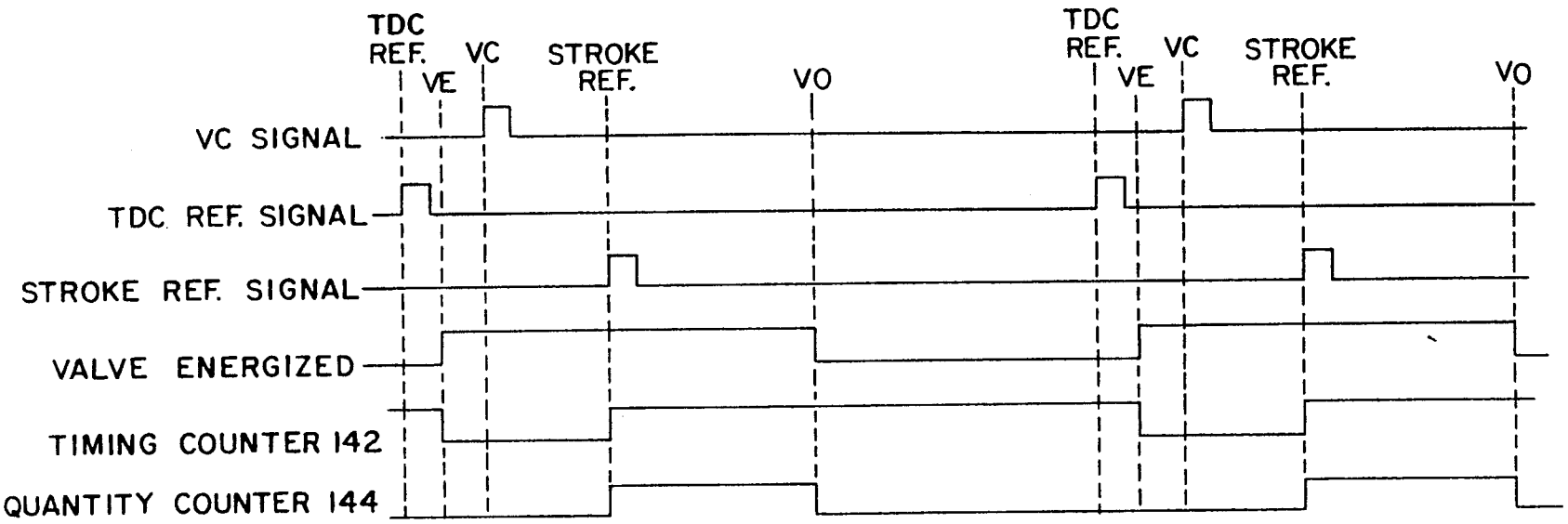
FIG. 3 is a timing chart showing the relationship of certain operations of the processor based control system and certain timing signals generated by the system.

As shown in FIG. 2, VC timing and start-of-pumping (SOP) timing occur essentially at the same radius on the intake and pumping ramps of the cam lobes. Actual fuel injection timing (i.e., start of fuel injection) occurs slightly later than SOP timing primarily due to the compression of fuel at the high fuel injection pressure. Thus, SOP timing and actual fuel injection timing are a function of (a) Stroke Ref. timing and (b) VC timing (or quantity of fuel metered to the high pressure pump 10 during the pump intake stroke). For any given Stroke Ref. timing, or if the stroke timing is fixed, SOP timing is precisely regulated solely by precisely regulating VC timing.

A Stroke Ref. sensor 110 and pump angle sensor 114 employ an indexing wheel 117 mounted on the rotor 104. The sensor 110 generates a Stroke Ref. timing signal used as a starting point for measuring and governing (a) a timing angle TA which, in combination with the valve response angle VRA and the Stroke Ref. timing, determines the actual fuel injection timing and (b) a quantity angle QA which determines the actual quantity of fuel injected. The angle sensor 114 generates an output train of equiangularly spaced pulses during each revolution of the pump rotor 104. Each small angular increment between sensor output pulses is electronically divided into many equal time increments (representing equal angles) by a suitable multiplier circuit 116 which functions as a high frequency pump clock. Where the cam ring 14 is adjustable, the pump sensor pickups 111, 115 are mounted on the cam ring 14 so that the sensor outputs are not affected by angular adjustment of the cam ring 14.

Suitable engine sensors 90–96 are employed for transmitting current engine data to the ECU 84. The engine sensors 90–96 include (a) a crankshaft timing sensor 90 for generating a TDC Ref. timing signal for each engine cycle, (b) an engine angle sensor 91, (c) an engine coolant temperature sensor 92, (d) an altitude or intake manifold pressure sensor 93, (e) a load demand sensor 94 (e.g., operated by an accelerator pedal in a vehicle application), (f) a fuel temperature sensor 95 and (g) a sensor 96 for sensing the air temperature within the intake manifold. As shown in FIG. 2, the TDC Ref. point is located before the corresponding Stroke Ref. point and the Stroke Ref. point is located approximately at the end of the pump intake stroke and beginning of the pumping stroke.

The actual fuel injection timing is precisely regulated during each cycle by precisely energizing the solenoid valve 30 at a rotor angle TA which is precisely determined and governed by the ECU 84. Similarly, the actual quantity of fuel injected is precisely regulated during each cycle by precisely deenergizing the solenoid valve 30 at a rotor angle QA which is precisely determined and governed by the ECU 84. The quantity angle QA is determined in part from the timing of valve energization VE, valve response angle VRA and Stroke Ref. timing (which together determine fuel injection timing).

Figure 5:
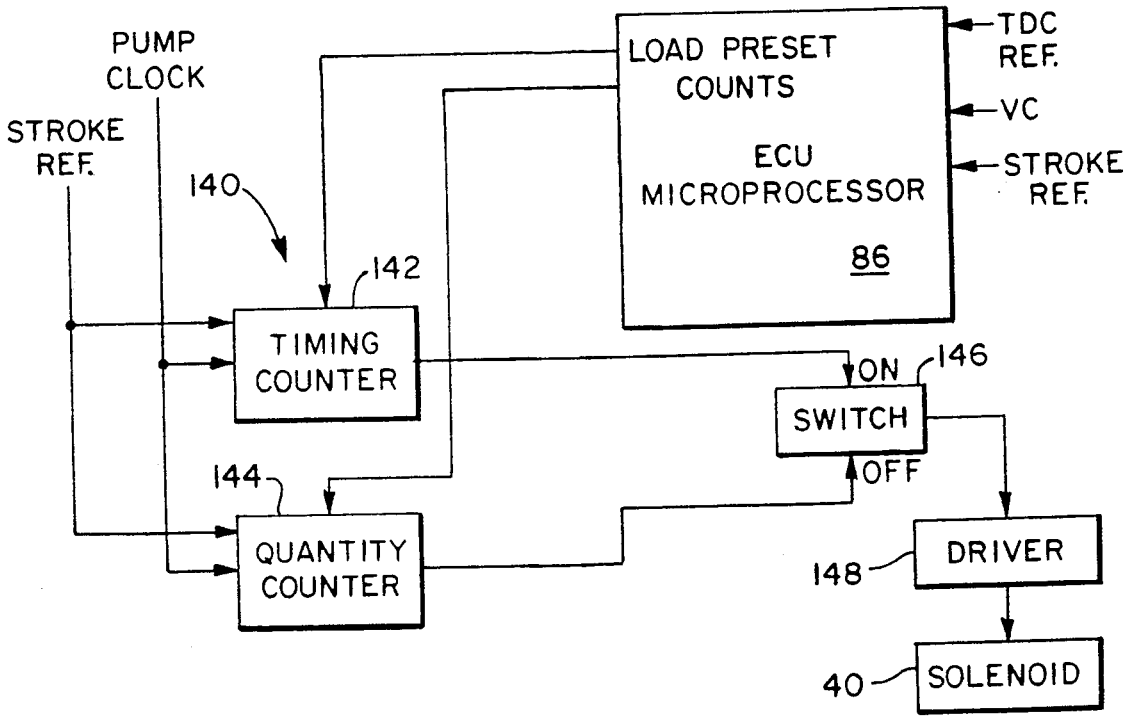
FIG. 5 is a block diagram of part of a counter network of the processor based control system.
Figure 6:
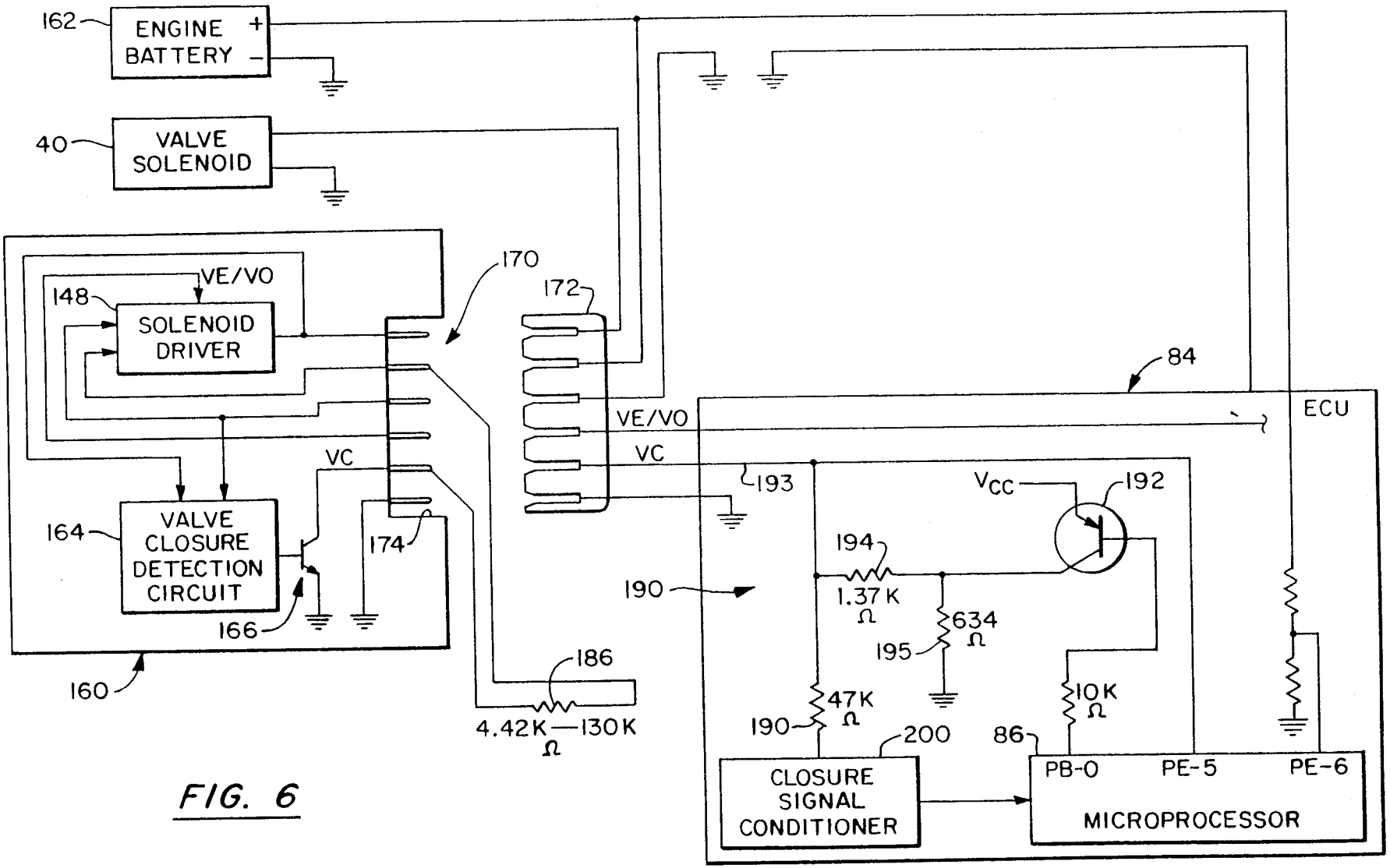
FIG. 6 is a diagram, partly shown schematically and partly shown diagrammatically, of certain electrical circuitry of the processor based control system.
Figure 7:
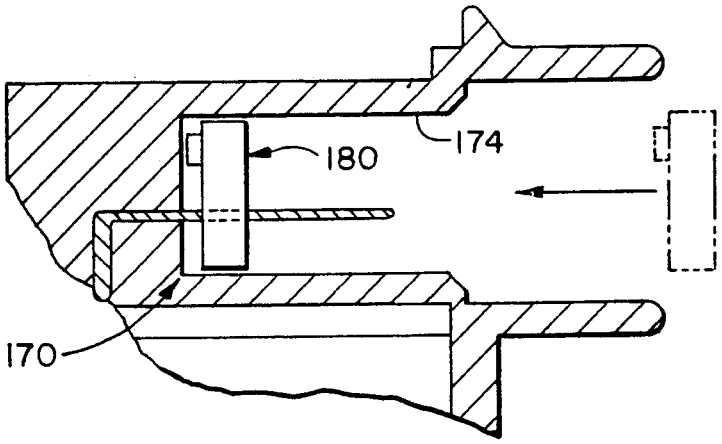
FIG. 7 is a partial section view, partly broken away and partly in section, of a pump module connector of the processor based control system.
Figure 8:
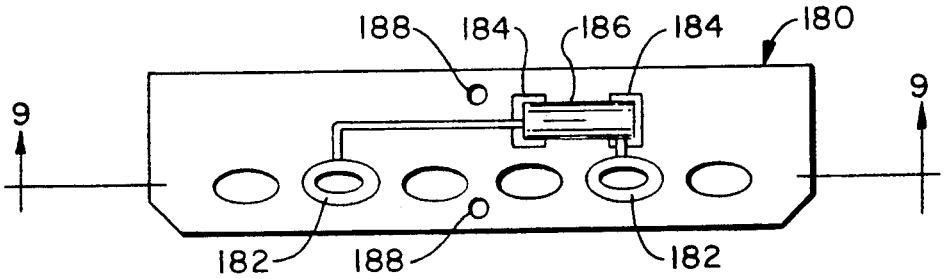
FIGS. 8 and 9 are plan and side views of a printed circuit board of the pump module connector.
Figure 9:
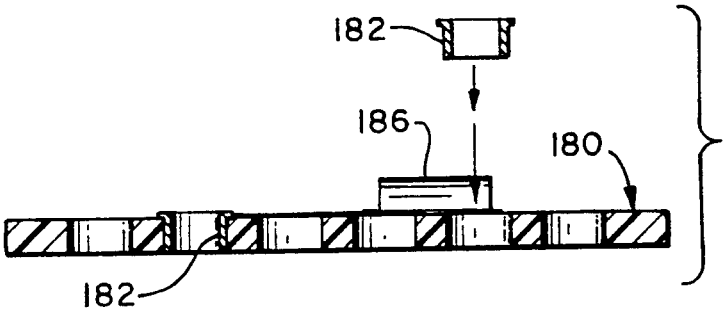

As described in detail in U.S. Pat. No. 5,103,792, the ECU 84 comprises a network of counters for regulating the timing of energization and deenergization of the solenoid valve 30. Referring to FIG. 5, the network 140 comprises two primary angle counters 142, 144 for measuring and governing the timing angle TA and quantity angle QA. The timing counter 142 measures and governs the timing angle TA between the Stroke Ref. point and valve energization VE. The quantity counter 144 measures and governs the quantity angle QA between the Stroke Ref. point and valve deenergization VO. During each cycle, each primary counter 142, 144 is preset at an angle count established by the ECU 84. Each primary counter 142, 144 is then stepped or clocked in the subtracting direction by the high frequency pump clock 116. The two primary counters 142, 144 are connected to a suitable logic circuitry 146 which serves as an on/off switch for a valve solenoid driver 148. During each cycle, each primary counter 142, 144 is started by the Stroke Ref. signal (at which point the valve solenoid 40 is energized). Thereafter, the quantity counter 144, when its count reaches zero, transmits a VO signal to the switch 146 to open valve 30. Thereafter, the timing counter 142, when its count reaches zero, transmits a VE signal to the switch 146 to reclose valve 30 to establish the fuel injection timing for the next fuel injection event.

Figure 4:
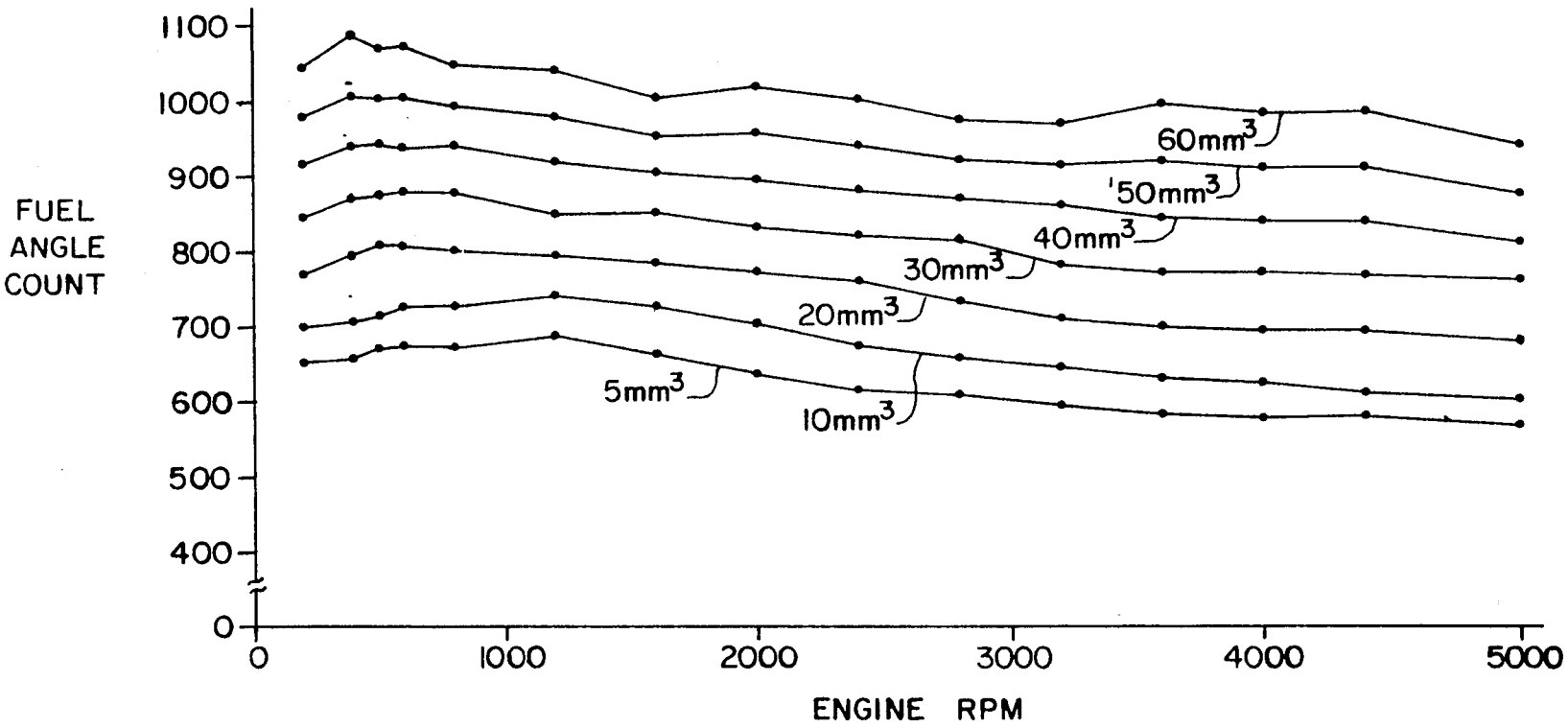
FIG. 4 is a graph showing a family of curves corresponding to a master calibration table stored in an EPROM of the processor based control system.

Referring to FIG. 4, the fixed calibration data stored in the EPROM includes a master quantity calibration table which provides a family of fuel quantity curves in 5 $mm^3$ increments. Each curve gives the quantity angle QA (i.e., a count of the pump clock 116 corresponding to the quantity angle QA) at each pump speed for injecting the specified quantity of fuel. The master calibration table includes a QA count for an appropriate number of speed points to accurately establish the curve. The same speed points are used on each quantity curve. The QA count for a fuel quantity between data points and between curves is determined by linear interpolation. The master family of curves is empirically established for each engine installation by an extensive calibration process.

The microprocessor 86 calculates the desired QA and TA counts based on the fixed and current operating data stored in the ECU memory 82. The TA count is calculated to achieve the desired fuel injection timing and then loaded into the timing counter 142 for the next cycle (after the valve 30 is energized for the current cycle). Then, the QA count is calculated based on the master calibration table data (as adjusted as hereafter described) to achieve the desired fuel injection quantity and the calculated QA count is then stored in memory 82. The QA count stored in memory is modified and loaded into the quantity counter 144 after the VC signal is received.

The solenoid driver 148 forms part of an electrical module 160 mounted on the pump housing. The driver 148 is connected to the engine battery 162 (e.g., providing a nominal 12 volt DC power supply) and is controlled by the valve operating signal (VE/VO) received from the ECU switch 146 (FIG. 5). The pump module 160 also includes a valve closure detection circuit 164 for producing the VC signal. The detection circuit 164 detects valve closure by detecting a change (reduction) in the solenoid operating voltage when the valve member 50 reaches its fully closed position. When the voltage change is detected, the detection circuit 164 closes an output transistor 166 to connect a VC signal line to ground to produce the VC signal. The output transistor remains closed until the solenoid valve 40 is deenergized.

The pump module 160 has a male connector 170 for receiving a compatible female connector plug 172. The female plug 172 has a split lead providing multiple (3) connections to the ECU 84 and separate connections to the solenoid 40 and engine battery 162. The male connector 170 has a housing forming a receptacle 174 for the female plug 172. The male connector 170 has a linear row of six evenly spaced connector pins. One pin is employed for transmitting the VC signal to the ECU 84. A second pin is employed for transmitting the valve operating signal (VE/VO) from the ECU 84 to the solenoid driver 148. A third pin provides a common ground for the ECU 84 and pump module 160 and a fourth pin connects the solenoid driver 148 to the positive terminal of the engine battery 162. A fifth pin connects the driver 148 to the battery ground and a sixth pin connects the driver output to the solenoid 40.

A small, elongated printed circuit board 180 is mounted on the male connector pins at the bottom of the male connector receptacle 174. The board insert 180 has a row of six pin openings for receiving the row of six male connector pins. Two of the pin openings have contact grommets or sleeves 182 for electrically connecting the corresponding pins to printed circuit pads 184 on the back of the board. A resistor 186 is surface mounted on the back of the board to provide a predetermined resistance between the pads 184.

As hereinafter described, the resistor 186 provides a predetermined electrical value or signal (i.e., analog voltage signal) for adjusting the master calibration table. Thus, the resistor 186 provides additional electrical data for use in controlling the injected fuel quantity. A calibration adjustment resistor 186 having any one of up to thirty-six (36) different predetermined resistance values, from 4.42K ohms to 130K ohms, is used. A resistor board 180 with an appropriate resistor 186 is installed when the pump 10 is initially produced and calibrated. The board 180 stays with the pump until the pump is recalibrated and a substitute board, with a different resistance value, is installed. The board 180 is normally securely retained at the bottom of the plug receptacle 174 by the connector plug 172. The board 180 has two, central, laterally spaced holes 188 for receiving a special plier-like tool (not shown) for removing the board 180. Removal of the board 180 is thereby restricted so that preferably, the board 180 is only removed and replaced by the pump manufacturer and authorized representatives as part of the calibration and recalibration process.

The calibration resistor 186 is electrically connected between the power supply (battery) pin and VC signal pin. When the detection circuit output transistor 166 is open, the power supply (battery) voltage is applied to the VC signal pin via the calibration resistor 186. A receiver circuit 190 within the ECU 84 is selectively operated by the microprocessor 86 to read the signal voltage produced by the calibration resistor 186. The signal voltage is read during an initialization sequence when the fuel injection system is powered on (e.g., when the engine switch (not shown) is turned on and before the engine is started) and while the output transistor 166 of the closure detection circuit 164 is open. During the initialization sequence, a transistor 192 of the ECU receiver 190, which serves as a mode selector, is held open by a PB-0 output from the microprocessor 86. The signal voltage at the ECU receiver input 193 (which is equal to the signal voltage at the VC signal pin) is then read by the microprocessor 86 at the PE-5 input. Two pull-down resistors 194, 195 (having a resistance of 1.37K ohms and 634 ohms respectively and a combined resistance of 2K ohms) are connected between the receiver input 193 and ground to establish an appropriate signal voltage range for the 36 available resistance values of the calibration resistor 186. An isolation resistor 198 connected between the receiver input 193 and a VC signal conditioning circuit 200 has a relatively high resistance of 47K ohms which does not significantly affect the signal voltage of the calibration resistor 186.

During normal engine operation, the mode selector transistor 192 is closed and the VC signal is transmitted via the isolation resistor 198 and VC signal conditioning circuit 200 to the microprocessor 86. As previously indicated, a VC signal is produced when the VC signal pin of the male connector 170 is connected to ground. Otherwise, the voltage in the VC signal line is primarily dependent upon the resistance (e.g., 1.37k ohms) of the resistor 194 (which then serves as a pull-up resistor) and the voltage Vcc (e.g., 5 volts) applied to the transistor 192. The resistance of the calibration resistor 186 has a minimum value (e.g., 4.42K ohms) significantly greater than the resistance of resistor 194. When the receiver input voltage falls below, for example, 0.8 volts, a VC signal is considered to have been produced.

The ECU 84 converts the analog voltage signal provided by the calibration resistor 186 to any one of thirty-six (36) adjustment values representing thirty-six (36 levels of adjustment. The conversion is performed by a suitable analog to digital conversion provided by the microprocessor 86. The adjustment value is then used to adjust the calibration data provided by the master calibration table. This calibration adjustment is performed either by (a) adjusting the QA count at each data point on each master quantity curve by a fixed predetermined small number or (b) by modifying the fuel quantity represented by each master quantity curve by a fixed predetermined small quantity. A different fixed adjustment is made for each adjustment value.

The fixed calibration adjustment provided by each calibration resistor 186 is established in accordance with the required range of adjustment needed as determined from empirical data. The calibration resistor 186 assigned to each pump is determined empirically (e.g., by measuring the actual quantity of fuel injected at one or more data points in the master calibration table). The actual quantity is obtained by a suitable test stand evaluation and is used to determine the appropriate calibration resistor 186. The pump is calibrated in that manner when the pump is produced and also when the pump is subsequently recalibrated, for example, after extended use of the pump, part replacement or other pump modification or overhaul. The board insert 180 and its calibration resistor 186 stay with the pump even when the pump is removed and installed on a different engine. The calibration adjustment is useful in calibrating pumps produced within a wide tolerance and can be used to relax certain tolerances. Also, the calibration adjustment accommodates significant variations in pump performance due to wear and due to variations in the operating characteristics of certain pump components such as the transfer pump and delivery valve.

As will be apparent to persons skilled in the art, various modifications, adaptations and variations of the foregoing specific disclosure can be made without departing from the teachings of the present invention.

What is claimed is:

1. In a fuel injection system having a fuel injection pump with reciprocating pumping means having a pumping cycle with an intake stroke to receive an intake charge of fuel and a pumping stroke to deliver a charge of fuel at high pressure for fuel injection, cam means for reciprocating the pumping means, a drive shaft for relative rotation of the cam means and pumping means to provide periodic pumping cycles at a rate proportional to said relative rotation, electrical valve means with open and closed positions and which, in the open position thereof, is operable to spill fuel from the pumping means during its pumping stroke, the electrical valve means being selectively operable for opening the valve means for regulating the fuel injection quantity, and rotation measuring means for generating a pump clocking pulse for each predetermined increment of said relative rotation; and valve governing means comprising a processor based electrical control unit (ECU) for storing certain data, including certain master calibration data, and for counting a preset count of said pump clocking pulses for each pumping cycle, each starting at a reference point therefor, the valve governing means regulating the fuel injection quantity by operating the valve means to open the valve means when said preset count is reached, the ECU establishing said preset count, to establish the fuel injection quantity, in accordance with said data, including said master calibration data; the improvement wherein the valve governing means comprises a pump mounted, electrical module having a hardware component with electrical calibration means for establishing electrical data representing a predetermined adjustment of said master calibration data, and connection means electrically connecting the pump mounted module, including said electrical means, to the ECU for the ECU to read said electrical data, and wherein the ECU establishes said preset count in accordance with the master calibration data as adjusted by the predetermined adjustment established by said electrical data, said hardware component being replaceable to establish different said electrical data representing a different said predetermined adjustment.

2. A fuel injection system according to claim 1 wherein said connection means comprises an electrical connector providing multiple electrical connections between the pump mounted module and ECU, the electrical connector comprising cooperating male and female connectors, one of the connectors forming part of the pump mounted module and the other connector being electrically connected to the ECU, and wherein said hardware component is removably mounted on said one connector.

3. A fuel injection system according to claim 1 wherein said electrical calibration means comprises at least one electrical component connected for establishing said electrical data.

4. A fuel injection system according to claim 3 wherein said one electrical component is a resistor.

5. A fuel injection system according to claim 1 wherein the hardware component is a printed circuit board having said electrical means.

6. A fuel injection system according to claim 1 wherein the pump mounted module includes an electrical driver for operating the electrical valve means, wherein the ECU is operable for generating a driver operating signal for controlling the operation of the valve means, and wherein the connection means comprises an electrical connector providing multiple electrical connections between the pump mounted module and ECU, the electrical connector comprising cooperating male and female connectors, the male connector forming part of the pump module and being electrically connected to the electrical driver, the female connector being electrically connected to the ECU, the male connector having a plurality of male connector pins including a set of connector pins providing said multiple connections between the pump mounted module and ECU, said hardware component being mounted on the male connector for electrical connection of the electrical calibration means to at least one of said set of pins for the ECU to read said electrical data.

7. A fuel injection system according to claim 6 wherein the hardware component comprises a printed circuit board having said electrical calibration means and having a plurality of openings receiving a plurality of connector pins respectively for connecting the electrical calibration means between said one connector pin and at least one additional connector pin to establish said electrical data.

8. A fuel injection system according to claim 7 wherein the pump mounted module includes a valve closure detection circuit for producing a valve closure signal, upon the closure of said valve means, at said one connector pin, and wherein the ECU includes a processor and a receiver selectively operated by the processor for separately reading the valve closure signal produced by said detection circuit and said electrical data produced by said electrical calibration means.

9. A fuel injection system according to claim 8 wherein said receiver comprises a mode selector selectively operated by the processor for selectively reading said valve closure signal and said electrical data.

10. In a fuel injection system having a fuel injection pump with reciprocating pumping means having a pumping cycle with an intake stroke to receive an intake charge of fuel and a pumping stroke to deliver a charge of fuel at high pressure for fuel injection, cam means for reciprocating the pumping means, a drive shaft for relative rotation of the cam means and pumping means to provide periodic pumping cycles at a rate proportional to said relative rotation, electrical valve means with open and closed positions and which, in the open position thereof, is operable to supply fuel to the pumping means during its intake stroke and to spill fuel from the pumping means during its pumping stroke, the electrical valve means being selectively operable for closing and opening the valve means for regulating the fuel injection timing and quantity, and rotation measuring means for generating a pump clocking pulse for each predetermined increment of said relative rotation; and valve governing means comprising a processor based electrical control unit (ECU) for storing certain data, including certain master calibration data, and for counting first and second preset counts of said pump clocking pulses for each pumping cycle, each starting at a reference point therefor, the valve governing means regulating the fuel injection timing and quantity by operating the valve means to close the valve means when said first preset count is reached and thereafter to open the valve means when said second preset count is reached, the ECU establishing said first and second preset counts, to establish the fuel injection timing and quantity, in accordance with said data, including establishing at least one of said preset counts in accordance with said master calibration data; the improvement wherein the valve governing means comprises a pump mounted, electrical module having a hardware component with electrical calibration means for establishing an electrical value representing a predetermined adjustment of said master calibration data, and connection means electrically connecting the pump mounted module, including said hardware component, to the ECU for the ECU to read said electrical value, and wherein the ECU establishes at least said one preset count in accordance with the master calibration data as adjusted by the predetermined adjustment established by said electrical value, said hardware component being replaceable to establish a different said electrical value representing a different said predetermined adjustment.

11. A fuel injection system according to claim 10 wherein said one preset count is said second preset count.

12. A fuel injection system according to claim 10 wherein the ECU includes a processor and a receiver selectively operated by the processor for selectively reading said electrical value produced by said electrical calibration means.

13. A fuel injection system according to claim 10 wherein the electrical calibration means is a resistor.

14. A fuel injection system according to claim 10 wherein said connection means comprises an electrical connector providing multiple electrical connections between the pump mounted module and ECU, the electrical connector comprising cooperating male and female connectors, one of the connectors forming part of the pump mounted module and the other connector being electrically connected to the ECU, and wherein said hardware component is removably mounted on said one connector.

15. In a fuel injection system having a fuel injection pump with reciprocating pumping means having a pumping cycle with an intake stroke to receive an intake charge of fuel and a pumping stroke to deliver a charge of fuel at high pressure for fuel injection, cam means for reciprocating the pumping means, a drive shaft for relative rotation of the cam means and pumping means to provide periodic pumping cycles at a rate proportional to said relative rotation, electrical valve means with open and closed positions and which, in the open position thereof, is operable to spill fuel from the pumping means during its pumping stroke, the electrical valve means being selectively operable for opening the valve means for regulating the fuel injection quantity; and valve governing means comprising a processor based electrical control unit (ECU) for storing certain data, including certain master calibration data, the valve governing means regulating the fuel injection quantity by operating the valve means to open the valve means at a predetermined point during the pumping stroke, the ECU establishing said predetermined point in accordance with said data, including said master calibration data; the improvement wherein the valve governing means comprises a pump mounted, electrical module having a hardware component with electrical calibration means for establishing electrical data representing a predetermined adjustment of said master calibration data, and connection means electrically connecting the pump mounted module, including said electrical calibration means, to the ECU for the ECU to read said electrical calibration data, and wherein the ECU establishes said predetermined point in accordance with the master calibration data as adjusted by the predetermined adjustment established by said electrical data, said hardware component being replaceable to establish different said electrical data representing a different said predetermined adjustment.

16. A fuel injection system according to claim 15 wherein said connection means comprises an electrical connector providing multiple electrical connections between the pump mounted module and ECU, the electrical connector comprising cooperating male and female connectors, one of the connectors forming part of the pump mounted module and the other connector being electrically connected to the ECU, and wherein said hardware component is removably mounted on said one connector.

17. A fuel injection system according to claim 15 wherein the pump mounted module includes an electrical driver for operating the electrical valve means, wherein the ECU is operable for generating a driver operating signal for controlling the operation of the valve means, and wherein the connection means comprises an electrical connector providing multiple electrical connections between the pump mounted module and ECU, the electrical connector comprising cooperating male and female connectors, the male connector forming part of the pump module and being electrically connected to the electrical driver, the female connector being electrically connected to the ECU, the male connector having a plurality of male connector pins including a set of connector pins providing said multiple connections between the pump mounted module and ECU, said hardware component being mounted on the male connector for electrical connection of the electrical calibration means with at least one of said set of pins for connecting the electrical calibration means to the ECU for the ECU to read said electrical data.

18. A fuel injection system according to claim 17 wherein the hardware component comprises a printed circuit board having said electrical calibration means and having a plurality of openings receiving a plurality of connector pins respectively for connecting the electrical calibration means between said one connector pin and at least one additional connector pin to establish said electrical data.

19. A fuel injection system according to claim 18 wherein the pump mounted module includes a valve closure detection circuit for producing a valve closure signal, upon the closure of said valve means, at said one connector pin, and wherein the ECU includes a processor and a receiver selectively operated by the processor for separately reading the valve closure signal produced by said detection circuit and said electrical data produced by said electrical calibration means.

* * * * *